US009938475B2

(12) United States Patent
Xu et al.

(10) Patent No.: US 9,938,475 B2
(45) Date of Patent: Apr. 10, 2018

(54) CATALYST CONFIGURATION FOR INCREASED HYDROCRACKING ACTIVITY

(71) Applicants: Xiaochun Xu, Sugar Land, TX (US); Amanda K. Miller, Houston, TX (US)

(72) Inventors: Xiaochun Xu, Sugar Land, TX (US); Amanda K. Miller, Houston, TX (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 0 days.

(21) Appl. No.: 14/877,018

(22) Filed: Oct. 7, 2015

(65) Prior Publication Data

US 2016/0115401 A1 Apr. 28, 2016

Related U.S. Application Data

(60) Provisional application No. 62/069,398, filed on Oct. 28, 2014, provisional application No. 62/152,076, filed on Apr. 24, 2015.

(51) Int. Cl.

| | |
|---|---|
| ***C10G 65/00*** | (2006.01) |
| ***C10G 65/12*** | (2006.01) |
| ***C10G 45/46*** | (2006.01) |
| ***C10G 47/02*** | (2006.01) |

(52) U.S. Cl.

CPC ..... *C10G 65/12* (2013.01); *C10G 45/46* (2013.01); *C10G 47/02* (2013.01); *C10G 2300/1096* (2013.01); *C10G 2300/202* (2013.01)

(58) Field of Classification Search

CPC ..... C10G 65/12; C10G 69/02; C10G 45/46; C10G 47/02; C10G 2300/1096; C10G 2300/202

See application file for complete search history.

(56) References Cited

U.S. PATENT DOCUMENTS

| | | | |
|---|---|---|---|
| 4,581,109 | A | 4/1986 | Goor et al. |
| 6,103,101 | A | 8/2000 | Fragelli et al. |
| 7,261,805 | B2 | 8/2007 | Grove et al. |
| 7,575,668 | B1 | 8/2009 | Nafis |
| 2006/0131212 | A1 | 6/2006 | Dahlberg et al. |
| 2008/0308459 | A1 | 12/2008 | Iki et al. |

(Continued)

OTHER PUBLICATIONS

PCT/US2015/054427 International Search Report and Written Opinion dated Jan. 7, 2016.

(Continued)

*Primary Examiner* — Prem C Singh
*Assistant Examiner* — Brandi M Doyle
(74) *Attorney, Agent, or Firm* — Andrew T. Ward

(57) ABSTRACT

Systems and methods are provided for producing an improved product slate during hydrocracking of a feedstock for production of naphtha and distillate fuels. The methods can include use of stacked beds and/or sequential reactors so that a feedstock is exposed to a suitable catalyst under aromatic saturation conditions prior to exposing the feedstock to the hydrocracking catalyst. The catalyst for performing the aromatic saturation process can be a catalyst including a Group VIII noble metal, such as Pt, Pd, or a combination thereof, while the hydrocracking catalyst can include Group VIB and Group VIII non-noble metals.

20 Claims, 1 Drawing Sheet

(56) References Cited

U.S. PATENT DOCUMENTS

| | | | | |
|---|---|---|---|---|
| 2009/0107883 | A1* | 4/2009 | Maesen | B01J 23/002 208/111.15 |
| 2009/0313890 | A1 | 12/2009 | Lopez et al. | |
| 2010/0089794 | A1 | 4/2010 | Bhan et al. | |
| 2011/0315596 | A1* | 12/2011 | Prentice | C10G 45/64 208/59 |
| 2012/0248008 | A1 | 10/2012 | Dougherty et al. | |
| 2013/0256192 | A1 | 10/2013 | Zimmerman et al. | |
| 2014/0042056 | A1 | 2/2014 | Daage et al. | |
| 2014/0144809 | A1 | 5/2014 | Kokayeff et al. | |

OTHER PUBLICATIONS

PCT/US2015/054420 International Search Report and Written Opinion dated Jan. 7, 2016.

* cited by examiner

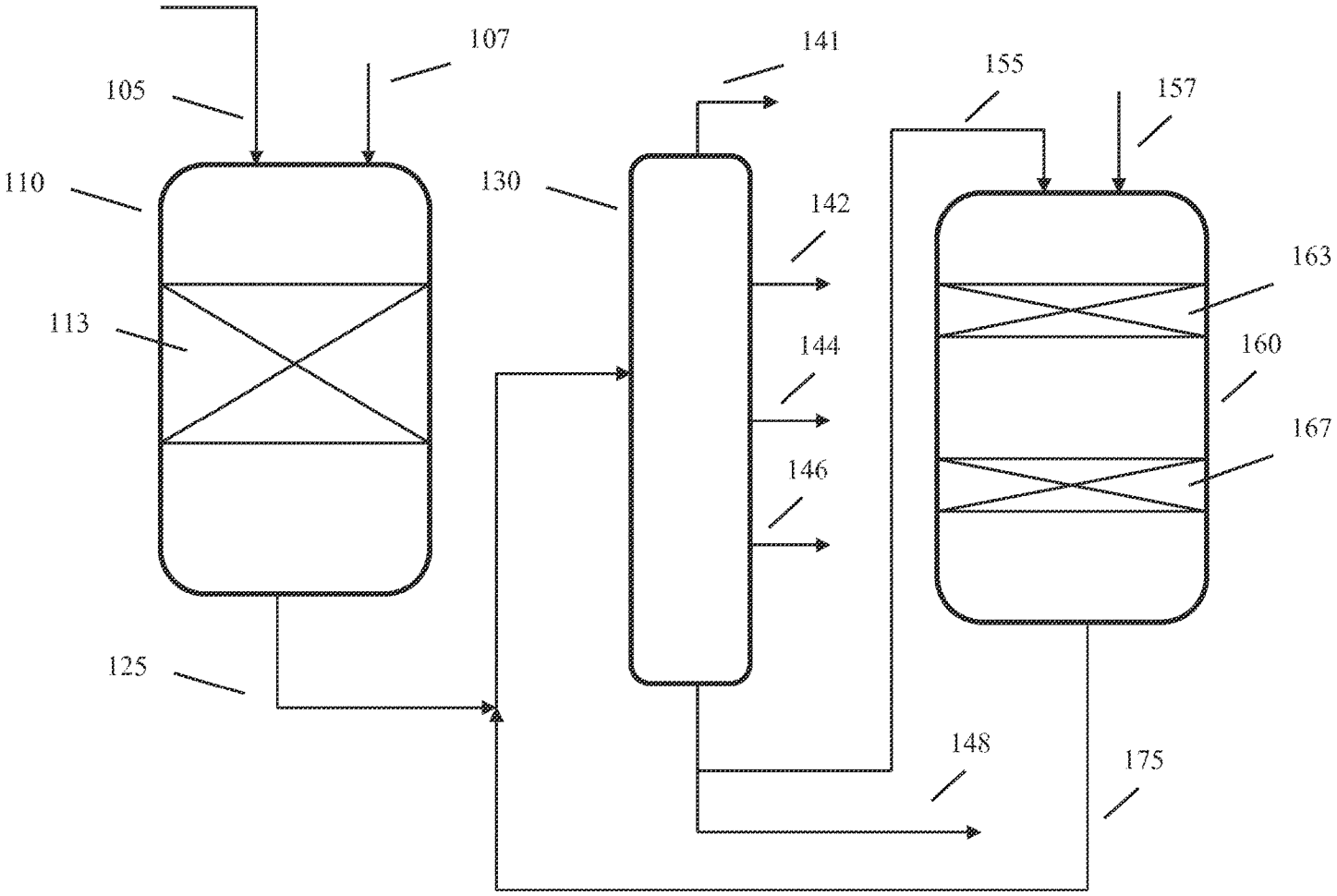
163
160
167
157
175
155
148
141
142
144
146
130
107
105
110
113
125

CATALYST CONFIGURATION FOR INCREASED HYDROCRACKING ACTIVITY

CROSS-REFERENCE TO RELATED APPLICATIONS

This application claims priority to U.S. Provisional Application Ser. No. 62/062,398 filed Oct. 28, 2014, herein incorporated by reference in its entirety. Additionally, this application also claims priority to U.S. Provisional Application Ser. No. 62/152,076 filed Apr. 24, 2015, herein incorporated by reference in its entirety.

FIELD

Methods are provided for hydroprocessing of feedstocks to produce distillate products.

BACKGROUND

Hydrocracking of hydrocarbon feedstocks is often used to convert lower value hydrocarbon fractions into higher value products, such as conversion of vacuum gas oil (VGO) feedstocks to various fuels and lubricants. Typical hydrocracking reaction schemes can include an initial hydrotreatment step, a hydrocracking step, and a post hydrotreatment step, such as dewaxing or hydrofinishing. After these steps, the effluent can be fractionated to separate out a desired diesel fuel and/or lubricant oil base oil.

A process train for hydrocracking a feedstock can be designed to emphasize the production of fuels or the production of lubricant base oils. During fuels hydrocracking, typically the goal of the hydrocracking is to cause conversion of higher boiling point molecules to molecules boiling in a desired range, such as the diesel boiling range, kerosene boiling range, and/or naphtha boiling range. Many types of fuels hydrocracking processes also generate a bottoms component from hydrocracking that potentially can be used as a lubricant base oil. However, the lubricant base oil is produced in a lesser amount, and often is recycled and/or hydrocracked again to increase the fuels yield. In hydrocracking for forming a lubricant base oil the goal of the hydrocracking is typically to remove contaminants and/or provide viscosity index uplift for the feed. This results in some feed conversion, however, so that a hydrocracking process for generating a lubricant base oil typically produces a lesser amount of fractions that boil in the diesel boiling range, kerosene boiling range, and/or naphtha boiling range. Due to the difference in the desired goals, the overall process conditions during fuels hydrocracking of a given feedstock typically differ from the overall process conditions during hydrocracking for lubricant base oil production on a similar type of feedstock.

U.S. Pat. No. 7,261,805 describes a method for dewaxing and cracking of hydrocarbon streams. A feedstock with an end boiling point exceeding 650° F. (343° C.) is contacted with a hydrocracking catalyst and an isomerization dewaxing catalyst to produce an upgraded product with a reduced wax content. The feedstock is described as contacting the hydrocracking catalyst first, but it is noted that the order of the steps can be changed without a significant decrease in yield.

U.S. Pat. No. 6,103,101 describes a method for hydroprocessing of a feedstock for either lubricant base oil production or for fuels production. The hydroprocessing includes sequentially contacting a feed with a demetallization catalyst, a hydrotreating catalyst that includes Group VIB and Group VIII base metals, a hydroisomerization/hydrocracking catalyst that includes Group VIB and/or Group VIII metals, and a hydrofinishing catalyst that includes Group VIB and Group VIII base metals. In one configuration described as being suitable for fuels production, the bottoms product from fractionation of the hydroprocessed effluent can be recycled to the beginning of the hydroprocessing sequence.

U.S. Patent Application Publication 2012/0248008 describes a method for fuels hydrocracking with dewaxing of fuel products. In a first stage, a feed is hydrotreated and/or hydrocracked, with the resulting effluent being exposed to a dewaxing catalyst. The dewaxing catalyst can be a ZSM-48 catalyst with supported Pt as a hydrogenation metal. The hydrotreated/hydrocracked and dewaxed effluent can then be fractionated to form fuel product streams. A bottoms portion from the fractionator can be passed into a second hydrotreating and/or hydrocracking stage for further conversion of the feed.

SUMMARY

In an aspect, a method is provided for processing a feedstock to form a distillate product, including exposing a feedstock having a T50 boiling point of at least about 430° F. (221° C.), a first aromatics content of at least about 5 wt %, and a sulfur content of about 500 wppm or less (or about 100 wppm or less, or about 50 wppm or less, or about 15 wppm or less) to an aromatic saturation catalyst comprising a Group VIII noble metal under effective aromatic saturation conditions to produce an aromatic saturation effluent, the aromatic saturation effluent having a second aromatics content of less than about 10 wt %, the second aromatics content being less than the first aromatics content; and exposing at least a portion of the aromatic saturation effluent to a hydrocracking catalyst under effective hydrocracking conditions to produce a hydrocracked effluent, the effective hydrocracking conditions being effective for converting at least about 5 wt % of the at least a portion of the aromatic saturation effluent relative to a conversion temperature of 430° F. (221° C.), the hydrocracking catalyst comprising at least one Group VIII non-noble metal, at least one Group VIB metal, or a combination thereof, wherein the hydrocracked effluent comprises at least a naphtha fuel product fraction and a distillate fuel product fraction.

In another aspect, a method is provided for processing a feedstock to form a distillate product, including exposing a feedstock having a T50 boiling point of at least about 430° F. (221° C.), a first aromatics content, and a sulfur content of about 500 wppm or less (or about 100 wppm or less, or about 50 wppm or less, or about 15 wppm or less) to an aromatic saturation catalyst comprising a Group VIII noble metal under effective aromatic saturation conditions to produce an aromatic saturation effluent, the aromatic saturation effluent having a second aromatics content, a ratio of the second aromatics content to the first aromatics content being about 0.6 or less; and exposing at least portion of the aromatic saturation effluent to a hydrocracking catalyst under effective hydrocracking conditions to produce a hydrocracked effluent, the effective hydrocracking conditions being effective for converting at least about 5 wt % of the at least a portion of the aromatic saturation effluent relative to a conversion temperature of 430° F. (221° C.), the hydrocracking catalyst comprising at least one Group VIII non-noble metal, at least one Group VIB metal, or a combination thereof; wherein the hydrocracked effluent comprises at least a naphtha fuel product fraction and a distillate fuel product fraction.

BRIEF DESCRIPTION OF THE DRAWINGS

FIG. 1 schematically shows an example of a reaction system for processing a feedstock to form naphtha and diesel boiling range fractions.

DETAILED DESCRIPTION

All numerical values within the detailed description and the claims herein are modified by "about" or "approximately" the indicated value, and take into account experimental error and variations that would be expected by a person having ordinary skill in the art.

Overview

In various aspects, systems and methods are provided for producing an improved product slate during hydrocracking of a feedstock for production of naphtha and distillate fuels. The methods can include use of stacked beds and/or sequential reactors so that a feedstock is exposed to a suitable catalyst under aromatic saturation conditions prior to exposing the feedstock to the hydrocracking catalyst. The catalyst for performing the aromatic saturation process can be a catalyst including a Group VIII noble metal, such as Pt, Pd, or a combination thereof, while the hydrocracking catalyst can include Group VIB and Group VIII non-noble metals. In various aspects, treating a feed with an initial aromatic saturation catalyst that includes a Group VIII noble metal instead of first treating the feed with a hydrocracking catalyst can allow for production of a naphtha fraction with increased octane; a diesel, jet, and/or distillate fuel fraction with improved cloud point and/or freezing point; and/or an increased amount of branched $C_4$ alkanes versus linear $C_4$ alkanes, so that the value of the $C_4$ alkanes for use (for example) as a alkylation feed is increased. Additionally or alternately, the total liquid product yield and/or the yield of one or more of the naphtha, distillate, or $C_4$ products can be enhanced.

In a hydroprocessing reaction system, one way of characterizing a reaction stage is based on the stage being a "sweet" reaction stage or a "sour" reaction stage. In this discussion, a reaction stage where the feedstock passed into to the stage contains at least about 500 wppm of sulfur, or at least about 1000 wppm of sulfur, can be referred to as a "sour" reaction stage. Optionally, the reaction stage can be characterized based on the sulfur content of both the feedstock and any treat gas passed into the reaction stage. A sour reaction stage can be in contrast to a "sweet" reaction stage, where the sulfur content in the feedstock passed into the stage is about 500 wppm or less, or about 300 wppm or less, or about 100 wppm or less, or about 50 wppm or less, or about 15 wppm or less.

In many reaction systems that include a hydrocracking catalyst, one or more initial reaction stages of the reaction system can correspond to sour reaction stages. Many types of petroleum feeds can have an elevated content of sulfur and/or nitrogen. An initial hydrotreatment and/or hydrocracking stage can be used to convert organically bound sulfur and nitrogen in the feed to compounds that are readily separated from the hydroprocessed feed, such as $H_2S$ and $NH_3$. A separator or fractionator can then be used to separate the $H_2S$ and $NH_3$ from the hydroprocessed effluent. The resulting separated hydroprocessed effluent can then have a sufficiently low sulfur content for one or more subsequent reaction stages to be considered as sweet processing stages. In a processing stage for reducing the sulfur (and optionally nitrogen) content of a feedstock, catalysts including base metals are typically used. This is in part due to the ability of base metal-containing catalysts to maintain a desirable level of activity in the presence of a feedstock with an elevated sulfur or nitrogen content.

In reaction systems involving multiple types of catalysts in a sweet reaction stage, conventional methods for arranging catalysts typically include arranging the catalysts so that a feedstock contacts base metal-containing catalysts prior to precious metal-containing catalysts. This conventional understanding for arrangement of catalysts is based on a variety of considerations. For example, many precious metal-containing catalysts have a reduced tolerance for heteroatom contaminants, such as sulfur or nitrogen. Placing precious metal-containing catalysts downstream in a reaction system can reduce or minimize the amount of heteroatom contaminants a precious metal-catalyst is exposed to, either during normal operation or during an unexpected event that causes downstream catalysts to be exposed to higher levels of heteroatom contaminants than normal. Additionally, using precious metal-containing catalysts later in a reaction sequence can potentially reduce the amount of catalyst needed, which can be beneficial for reducing the overall cost of a reaction system. Having a mixture of precious metal-containing catalysts and base metal-containing catalysts in a catalyst bed is also usually avoided. For example, during a catalyst changeout, it can be desirable to recover as much of a precious metal-containing catalyst as possible for recycle of the metal components. Having base metal-containing catalysts mixed with a precious metal-containing catalyst can make this process more difficult.

Without being bound by any particular theory, it is believed that hydrocracking of aromatic compounds in a feedstock under sweet conditions typically occurs by first saturating the aromatic compound followed by cracking of ring structures. In a conventional hydrocracking process, the hydrocracking conditions can be suitable for performing both the aromatic saturation and the subsequent cracking of ring structures. However, the sequential nature of the aromatic saturation and ring-cleaving processes may create a need for additional severity in the reaction conditions for a hydrocracking process in order to achieve a desired level of conversion.

In various aspects, the severity of reaction conditions for a hydrocracking process in a sweet environment can be reduced or minimized by first exposing a feed containing aromatic compounds to an aromatic saturation catalyst that includes a Group VIII noble metal under aromatic saturation conditions. Under the aromatic saturation conditions, at least a portion of the aromatic compounds in the feed can be saturated based on the use of a catalyst with strong hydrogenation activity. Including a Group VIII noble metal as a hydrogenation metal on an aromatic saturation catalyst can provide enhanced aromatic saturation activity, as compared with typical aromatic saturation activity for a catalyst containing a Group VIB and/or Group VIII non-noble metal. The effluent from aromatic saturation can then be exposed to a hydrocracking catalyst that includes one or more base metals such as Group VIB and/or Group VIII non-noble metals. Because a substantial amount of aromatic saturation has already been performed, the severity of the hydrocracking conditions can be reduced while still achieving a desired level of conversion. The reduction in the severity of hydrocracking conditions for a desired level of conversion can allow for forming of one or more products with increased isomerization during hydrocracking, which can lead to improved product properties. Without being bound by any particular theory, it is believed that the increased isomerization at a given level of conversion represents a reduction in thermal cracking of a feed at a given level of conversion in favor of hydrocracking.

In this discussion, the severity of hydroprocessing performed on a feed can be characterized based on the temperature, pressure, and/or liquid hourly space velocity. In general, higher temperatures and pressures correspond to increased severity for processing conditions, while higher space velocities tend to correspond to lower severity conditions. Although treat gas rate is specified as a processing condition, the relationship between treat gas rate and/or hydrogen consumption relative to process severity is not as straightforward. Instead, in sonic aspects, the treat gas rate and/or hydrogen consumption for a process can represent an additional cost for performing a process. Thus, reducing or minimizing hydrogen consumption can be a benefit from performing a process, as opposed to an indication of a change in the severity of processing conditions.

In various aspects, the hydrocracking conditions in the reaction system can be selected to generate a desired level of conversion of a feed. Conversion of a feed is defined in terms of conversion of molecules that boil above a temperature threshold to molecules below that threshold. The conversion temperature can be any convenient temperature. For example, for a fuels hydrocracking process, a suitable conversion temperature can be from about 390° F. (199° C.) to about 470° F. (243° C.). Unless otherwise specified, the conversion temperature in this discussion is a conversion temperature of 430° F. (221° C.).

In this discussion, the amount of conversion can correspond to the total conversion of molecules within a stage of the reaction system where the feedstock (or optionally the feedstock plus the treat gas) has a sulfur content of 500 wppm or less. Suitable amounts of conversion across the sweet reaction stage(s) can correspond to at least about 5 wt % conversion of 430° F.+(221° C.+) portions of the feedstock to portions boiling below 430° F., or at least about 10 wt %, or at least about 15 wt %, or at least about 20 wt %. In various aspects, the amount of conversion is about 90 wt % or less, or about 75 wt % or less, or about 50 wt % or less. This conversion in the sweet reaction stage(s) is in addition to any conversion that may occur in one or more prior sour reaction stages. It is noted that the amount of conversion refers to conversion during a single pass through the sweet reaction stage(s). For example, in a fuels hydrocracking system, a portion of the unconverted feed that boils above the distillate fuel range can be recycled to the beginning of the sweet reaction stage(s) and/or to another earlier point in the reaction system for further hydroprocessing.

In this discussion, a Group VIII noble metal refers to a metal selected from Pt, Pd, Rh, IR, Ru, or Os, preferably Pt, Pd, or a combination thereof. A Group VIII non-noble metal refers to Fe, Co, or Ni, preferably Co, Ni, or a combination thereof. A Group VIB metal refers to Cr, Mo, or W, preferably Mo, W, or a combination thereof.

In this discussion, a stage can correspond to a single reactor or a plurality of reactors. Optionally, multiple parallel reactors can be used to perform one or more of the processes, or multiple parallel reactors can be used for all processes in a stage. Each stage and/or reactor can include one or more catalyst beds containing hydroprocessing catalyst. Note that a "bed" of catalyst in the discussion below can refer to a partial physical catalyst bed. For example, a catalyst bed within a reactor could be filled partially with a hydrocracking catalyst and partially with a dewaxing catalyst. For convenience in description, even though the two catalysts may be stacked together in a single catalyst bed, the hydrocracking catalyst and dewaxing catalyst can each be referred to conceptually as separate catalyst beds.

In this discussion, unless otherwise specified a distillate fuel product fraction, such as a diesel product fraction, corresponds to a product fraction having a boiling range from about 177° C. (350° F.) to about 370° C. (700° F.). Thus, distillate fuel product fractions have initial boiling points (or alternatively T5 boiling points) of at least about 177° C. and final boiling points (or alternatively T95 boiling points) of about 370° C. or less. A naphtha fuel product fraction corresponds to a product fraction having a boiling range from about 36° C. (97° F.) to about 177° C. (350° F.). Thus, naphtha fuel product fractions have initial boiling points (or alternatively T5 boiling points) of at least about 36° C. and final boding points (or alternatively T95 boiling points) of about 177° C. or less. It is noted that 36° C. roughly corresponds to a boiling point for the various isomers of a $C_5$ alkane. A kerosene fuel product fraction (which could alternatively be referred to as a jet product fraction) corresponds to a product fraction having a boiling range from about 143° C. (290° F.) to about 221° C. (430° F.). Thus, kerosene fuel product fractions have initial boiling points (or alternatively T5 boiling points) of at least about 143° C. and final boiling points (or alternatively T95 boiling points) of about 221° C. or less. When determining a boiling point or a boiling range for a feed or product fraction, an appropriate ASTM test method can be used, such as the procedures described in ASTM D2887 or D86.

Feedstocks

A wide range of petroleum and chemical feedstocks can be hydroprocessed in accordance with the present invention. Some suitable feedstocks include gas oils, such as vacuum gas oils. More generally, suitable feedstocks include whole and reduced petroleum crudes, atmospheric and vacuum residua, solvent deasphalted residua, cycle oils, FCC tower bottoms, gas oils, including atmospheric and vacuum gas oils and coker gas oils, light to heavy distillates including raw virgin distillates, hydrocrackates, hydrotreated oils, dewaxed oils, slack waxes, Fischer-Tropsch waxes, raffinates, and mixtures of these materials.

One way of defining a feedstock is based on the boiling range of the feed. One option for defining a boiling range is to use an initial boiling point tier a feed and/or a final boiling point for a feed. Another option, which in some instances may provide a more representative description of a fed, is to characterize a feed based on the amount of the feed that boils at one or more temperatures. For example, a "T5" boiling point for a feed is defined as the temperature at which 5 wt % of the feed will boil off. Similarly, a "T10" boiling point is a temperature at which 10 wt % of the feed will boil, a "T50" boiling point is a temperature at which 50 wt % of the feed will boil, a "T95" boiling point is a temperature at which 95 wt % of the feed will boil, while a "T99.5" boiling point is a temperature at which 99.5 wt % of the feed will boil.

The feedstock used can vary depending on a desired mix of output products. In some aspects, any feed suitable for use a fuels hydrocracking feed can be used as a feedstock. In some aspects, production of distillate products can be preferred, although the methods described herein are also suitable for processing of feeds with substantial amounts of naphtha boiling range compounds and/or feeds with substantial amounts of naphtha after processing. For example, suitable feeds can include feeds with a T50 boiling point of at least about 430° F. (221° C.) (i.e., where at least about 50 wt % of the feed has a boiling point greater than 430° F.), or at least about 473° F. (245° C.), or at least about 527° F. (275° C.), or at least about 572° F. (300° C.), or at least about 600° F. (316° C.). Alternatively, a feed may be characterized using a T5 boiling point, such as a feed with a T5 boiling point of at least 430° F. (221° C.), or at least about 473° F. (245° C.), or at least about 527° F. (275° C.), or at least about 572° F. (300° C.), or at least about 600° F. (316° C.). Feeds with higher boiling ranges, such as feeds with higher T5 boiling points, can be increasingly suitable for generating higher yields of distillate fuel products. In some aspects, feeds can be selected with a boiling range corresponding to an atmospheric gas oil or less. Such a feed can have a T95 boiling point of about 800° F. (427° C.) or less, or about 750° F. (399° C.) or less, or about 700° F. (371° C.) or less, or about 650° F. (343° C.) or less. Alternatively, a heavier feed can be used that includes vacuum gas oil boiling range components. Such a feed can have a T95 boiling point of about 1100° F. (593° C.) or less, or about 1050° F. (566° C.) or less, or about 1000° F. (538° C.) or less, or about 950° F. (510° C.) or less, or about 900° F. (482° C.) or less.

In embodiments involving an initial sulfur removal stage (or stages) prior to hydrocracking, the sulfur content of the feed (prior to sulfur removal) can be at least about 100 ppm by weight of sulfur, or at least about 500 wppm, or at least about 1000 wppm, or at least about 2000 wppm, or at least about 4000 wppm, or at least about 20,000 wppm, such as up to about 40,000 wppm or more. After the initial sulfur removal stages, the desulfurized effluent can have a sulfur content of about 500 wppm or less, or about 300 wppm or less, or about 100 wppm or less, or about 50 wppm or less, or about 15 wppm or less. In other embodiments, including some embodiments where a previously hydrotreated and/or hydrocracked feed is used, the sulfur content can be about 500 wppm or less, or about 300 wppm or less, or about 100 wppm or less, or about 50 wppm or less, or about 15 wppm or less.

In some embodiments, at least a portion of the feed can correspond to a feed derived from a biocomponent source. In this discussion, a biocomponent feedstock refers to a hydrocarbon feedstock derived from a biological raw material component, from biocomponent sources such as vegetable, animal, fish, and/or algae. Note that, for the purposes of this document, vegetable fats/oils refer generally to any plant based material, and can include fat/oils derived from a source such as plants of the genus Jatropha. Generally, the biocomponent sources can include vegetable fats/oils, animal fats/oils, fish oils, pyrolysis oils, and algae lipids/oils, as well as components of such materials, and in some embodiments can specifically include one or more type of lipid compounds. Lipid compounds are typically biological compounds that are insoluble in water, but soluble in nonpolar (or fat) solvents. Non-limiting examples of such solvents include alcohols, ethers, chloroform, alkyl acetates, benzene, and combinations thereof.

Hydroprocessing with Improved Product Properties and Yields

Various types of hydroprocessing can be used in the production of distillate products. Typical processes include initial hydrotreating and/or hydrocracking processes to remove contaminant heteroatoms, such as sulfur, nitrogen, and/or oxygen from a feed. The hydrotreated and/or hydrocracked feed can then be fractionated to form one or more fuel fractions, such as a naphtha boiling range fraction, a jet or kerosene boiling range fraction, or a diesel boiling range fraction. Optionally, multiple fractions in a given boiling range can be formed, such as a light naphtha fraction and a heavy naphtha fraction. Typically a light ends fraction and a bottoms fraction can also be formed. Optionally, the diesel fraction can correspond to the bottoms fraction. Optionally, a $C_4$ (butane) fraction can be separated from the light ends fraction, either during or after the fractionation.

The bottoms fraction from the fractionation, having a sulfur content of about 500 wppm or less, or about 300 wppm or less, preferably about 100 wppm or less, or about 50 wppm or less, or about 15 wppm or less, can then be exposed to an aromatics saturation catalyst that includes a Group VIII noble metal under effective aromatic saturation conditions. The effluent from the aromatic saturation step can then be hydrocracked under effective hydrocracking conditions in the presence of a catalyst including one or more base metals, such as one or more Group VIB or Group VIII non-noble metals. The aromatic saturated, hydrocracked effluent can then be passed into the same fractionator or a different fractionator for separation of desired fuel products. This effectively sets up a recycle loop between the fractionator and the aromatic saturation hydrocracking stage(s), as components from the aromatics saturation/hydrocracking stage that correspond to the bottoms from the fractionator can be returned to the aromatics saturation/hydrocracking stage for multiple passes. In some aspects, the recycle loop may only correspond to a portion of the bottoms from the fractionator, while a second portion of the bottoms is drawn off as a product stream, such as a diesel fuel product.

In some aspects, the effluent from the aromatic saturation/hydrocracking stage(s) may also be passed through or more dewaxing catalyst beds and/or additional aromatic saturation catalyst beds prior to fractionation. This can allow for further upgrading of product properties, such as further improvement of the cold flow properties for a diesel fuel fraction.

FIG. 1 schematically shows an example of a configuration for performing fuels hydrocracking. In FIG. 1, a feed 105 and a hydrogen-containing treat gas 107 are passed into a reactor 110. Reactor 110 is shown as having a single catalyst bed 113, but any convenient number of catalyst beds can be used. Similarly, a single reactor 110 is shown, but any convenient number of reactors could be used, optionally with gas-liquid separators (not shown) between reactors. The feed is exposed to the catalyst in catalyst bed(s) 113 under effective conditions for reducing the heteroatom content of the feed. Catalyst bed(s) 113 can include any convenient combination of hydrotreating and/or hydrocracking catalysts for converting a sour feedstock to form an effluent that can be used at least in part in a sweet hydroprocessing stage. The effluent 125 is then passed into a fractionator 130. Fractionator 130 can represent any convenient number of separators and/or fractionator for generating a desired number of fractions. FIG. 1 schematically shows fractionator 130 as generating a light ends fraction 141, a light naphtha fraction 142, a heavy naphtha fraction 144, a jet or kerosene fraction 146, and a bottoms (diesel) fraction 148. Optionally, a gas-liquid separation (not shown) can be performed on effluent 125, so that only a liquid portion of effluent 125 is passed into fractionator 130. In this type of alternative, one or more of the output streams from fractionator 130 might instead be generated from the gas-liquid separator. Optionally, a diesel fraction (not shown) separate from bottoms fraction 148 can be generated. In various aspects, the liquid portion of effluent 125 can have a desired sulfur content, such as a sulfur content of 500 wppm or less, or 300 wppm or less, or 100 wppm or less, or 50 wppm or less, or 15 wppm or less.

A portion 155 of bottoms fraction 148 is then passed into a second reactor 160, along with a second hydrogen-containing treat gas stream 157. The input feeds to second reactor 160 are first exposed to one or more beds of aromatic saturation catalyst 163, followed by one or more beds of a hydrocracking catalyst 167. The resulting hydrocracked effluent 175 is then passed into a fractionator. In the configuration shown in FIG. 1, hydrocracked effluent 175 is returned to the fractionator 130 that is used for fractionation of first stage effluent 125. In alternative configurations, a separate fractionator can be used for fractionation of hydrocracked effluent 175.

It is noted that the configuration shown in FIG. 1 corresponds to a configuration for processing of a feed with a sulfur content of at least 100 wppm, such as at least about 500 wppm. If a feed has a suitably low sulfur content, reactor 110 could be omitted and the low sulfur feed could be directly introduced into reactor 160.

It is noted that the configuration in FIG. 1 shows a recycle of a portion of the bottoms fraction to the second reactor 160. In various aspects, a recycle loop is not required to achieve the benefits of the catalyst configuration described herein. Instead, the second reactor 160 can be operated in a single pass mode, so that the effluent from reactor 160 is fractionated into various types of product streams that can be used as products and/or passed to other reaction systems. In various aspects, it can be convenient to use a first separation stage for separation or fractionation of the effluent from a sour stage (such as reactor 110) and a second, different separation stage for fractionation of the sweet stage product effluent.

Hydrotreatment and Sour Hydrocracking Conditions

Hydrotreatment is typically used to reduce the sulfur, nitrogen, and aromatic content of a feed. The catalysts used for hydrotreatment can include conventional hydroprocessing catalysts, such as those that comprise at least one Group VIII non-noble metal (Columns 8-10 of IUPAC periodic table), preferably Fe, Co, and/or Ni, such as Co and/or Ni; and at least one Group VIB metal (Column 6 of IUPAC periodic table), preferably Mo and/or W. Such hydroprocessing catalysts can optionally include transition metal sulfides. These metals or mixtures of metals are typically present as oxides or sulfides on refractory metal oxide supports. Suitable metal oxide supports include low acidic oxides such as silica, alumina, titania, silica-titania, and titania-alumina. Suitable aluminas are porous aluminas such as gamma or eta having average pore sizes from 50 to 200 Å, or 75 to 150 Å; a surface area from 100 to 300 $m^2/g$, or 150 to 250 $m^2/g$; and a pore volume of from 0.25 to 1.0 $cm^3/g$, or 0.35 to 0.8 $cm^3/g$. The supports are preferably not promoted with a halogen such as fluorine as this generally increases the acidity of the support.

The at least one Group VIII non-noble metal, in oxide form, can typically be present in an amount ranging from about 2 wt % to about 40 wt %, preferably from about 4 wt % to about 15 wt %. The at least one Group VIB metal, in oxide form, can typically be present in an amount ranging from about 2 wt % to about 70 wt %, preferably for supported catalysts from about 6 wt % to about 40 wt % or from about 10 wt % to about 30 wt %. These weight percents are based on the total weight of the catalyst. Suitable metal catalysts include cobalt/molybdenum (1-10% Co as oxide, 10-40% Mo as oxide), nickel/molybdenum (1-10% Ni as oxide, 10-40% Co as oxide), or nickel/tungsten (1-10% Ni as oxide, 10-40% W as oxide) on alumina, silica, silica-alumina, or titania.

Alternatively, the hydrotreating catalyst can be a bulk metal catalyst, or a combination of stacked beds of supported and bulk metal catalyst. By bulk metal, it is meant that the catalysts are unsupported wherein the bulk catalyst particles comprise 30-100 wt. % of at least one Group VIII non-noble metal and at least one Group VIB metal, based on the total weight of the bulk catalyst particles, calculated as metal oxides and wherein the bulk catalyst particles have a surface area of at least 10 $m^2/g$. It is furthermore preferred that the bulk metal hydrotreating catalysts used herein comprise about 50 to about 100 wt %, and even more preferably about 70 to about 100 wt %, of at least one Group VIII non-noble metal and at least one Group VIB metal, based on the total weight of the particles, calculated as metal oxides. The amount of Group VIB and Group VIII non-noble metals can easily be determined VIB TEM-EDX.

Bulk catalyst compositions comprising one Group VIII non-noble metal and two Group VIB metals are preferred. It has been found that in this case, the bulk catalyst particles are sintering-resistant. Thus the active surface area of the bulk catalyst particles is maintained during use. The molar ratio of Group VIB to Group VIII non-noble metals ranges generally from 10:1-1:10 and preferably from 3:1-1:3. In the case of a core-shell structured particle, these ratios of course apply to the metals contained in the shell. If more than one Group VIB metal is contained in the bulk catalyst particles, the ratio of the different Group VIB metals is generally not critical. The same holds when more than one Group VIII non-noble metal is applied. In the case where molybdenum and tungsten are present as Group VIB metals, the molybdenum:tungsten ratio preferably lies in the range of 9:1-1:9. Preferably the Group VIII non-noble metal comprises nickel and/or cobalt. It is further preferred that the Group VIB metal comprises a combination of molybdenum and tungsten. Preferably, combinations of nickel/molybdenum/tungsten and cobalt/molybdenum/tungsten and nickel/cobalt/molybdenum/tungsten are used. These types of precipitates appear to be sinter-resistant. Thus, the active surface area of the precipitate is maintained during use. The metals are preferably present as oxidic compounds of the corresponding metals, or if the catalyst composition has been sulfided, sulfidic compounds of the corresponding metals.

It is also preferred that the bulk metal hydrotreating catalysts used herein have a surface area of at least 50 $m^2/g$ and more preferably of at least 100 $m^2/g$. It is also desired that the pore size distribution of the bulk metal hydrotreating catalysts be approximately the same as the one of conventional hydrotreating catalysts. Bulk metal hydrotreating catalysts have a pore volume of 0.05-5 ml/g, or of 0.1-4 ml/g, or of 0.1-3 ml/g, or of 0.1-2 ml/g determined by nitrogen adsorption. Preferably, pores smaller than 1 nm are not present. The bulk metal hydrotreating catalysts can have a median diameter of at least 50 nm, or at least 100 nm. The bulk metal hydrotreating catalysts can have a median diameter of not more than 5000 μm, or not more than 3000 μm. In an embodiment, the median particle diameter lies in the range of 0.1-50 μm and most preferably in the range of 0.5-50 μm.

The hydrotreatment is carried out in the presence of hydrogen. A hydrogen stream is, therefore, fed or injected into a vessel or reaction zone or hydroprocessing zone in which the hydroprocessing catalyst is located. Hydrogen, which is contained in a hydrogen-containing "treat gas," is provided to the reaction zone. Treat gas, as referred to in this invention, can be either pure hydrogen or a hydrogen-containing gas, which is a gas stream containing hydrogen in an amount that is sufficient for the intended reaction(s), optionally including one or more other gasses (e.g., nitrogen and light hydrocarbons such as methane), and which will not adversely interfere with or affect either the reactions or the products. Impurities, such as $H_2S$ and $NH_3$ are undesirable and would typically be removed from the treat gas before it is conducted to the reactor. The treat gas stream introduced into a reaction stage will preferably contain at least about 50 vol. % and more preferably at least about 75 vol. % hydrogen.

Hydrotreating conditions can include temperatures of about 200° C. to about 450° C., or about 315° C. to about 425° C.; pressures of about 250 psig (1.8 MPag) to about 5000 psig (34.6 MPag) or about 300 psig (2.1 MPag) to about 3000 psig (20.8 MPag); liquid hourly space velocities (LHSV) of about 0.1 hr to about 10 $hr^{-1}$; and hydrogen treat rates of about 200 scf/B (35.6 $m^3/m^3$) to about 10,000 scf/B (1781 $m^3/m^3$), or about 500 (89 $m^3/m^3$) to about 10,000 scf/B (1781 $m^3/m^3$).

In some aspects, hydrocracking can be used in place of or in addition to hydrotreating for removal of heteroatom contaminants. Suitable hydrocracking catalysts for heteroatom removal can include hydrotreating catalysts as described above, as well as hydrocracking catalysts as described below. A hydrocracking process performed under sour conditions, such as conditions where the sulfur content of the input feed to the hydrocracking stage is at least 500 wppm, can be carried out at temperatures of about 550° F. (288° C.) to about 840° F. (449° C.), hydrogen partial pressures of from about 250 psig to about 5000 psig (1.8 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions can include temperatures in the range of about 600° F. (343° C.) to about 815° F. (435° C.), hydrogen partial pressures of from about 500 psig to about 3000 psig (3.5 MPag-20.9 MPag), liquid hourly space velocities of from about 0.2 $h^{-1}$ to about 2 $h^{-1}$ and hydrogen treat gas rates of from about 213 $m^3/m^3$ to about 1068 $m^3/m^3$ (1200 SCF/B to 6000 SCF/B).

Hydrofinishing and/or Aromatic Saturation Process

In aspects where an initial stage is used for heteroatom removal, the effluent from the initial stage can be fractionated. At least a portion of the bottoms from the fractionator can then be exposed to an aromatic saturation catalyst under effective aromatic saturation conditions.

In various aspects, for aromatic saturation under sweet conditions prior to hydrocracking, suitable aromatic saturation catalysts can correspond to catalysts containing one or more Group VIII noble metals, such as Pt, Pd, or combinations thereof. Suitable metal oxide supports include low acidic oxides such as silica, alumina, silica-aluminas or titania, preferably alumina. The support materials may also be modified, such as by halogenation, or in particular fluorination. The amount of supported Group VIII noble metal can be about 0.1 wt % to about 2.0 wt % based on the weight of the catalyst, such as about 0.1 wt % to about 1.8 wt %, or about 0.1 wt % to about 1.5 wt %, or about 0.1 wt % to about 1.2 wt %, or about 0.1 wt % to about 0.9 wt %, or about 0.3 wt % to about 1.8 wt %, or about 0.3 wt % to about 1.5 wt %, or about 0.3 wt % to about 1.2 wt %, or about 0.3 wt % to about 0.9 wt %, or about 0.6 wt % to about 1.8 wt %, or about 0.6 wt % to about 1.5 wt %, or about 0.6 wt % to about 1.2 wt %. Optionally, if an aromatic saturation catalyst includes both Pt and Pd, the Pt and Pd can be included in any convenient ratio, such as 90:10 Pt to Pd, or 75:25, or 60:40, or 50:50, or 40:60, or 25:75, or 10:90. In an aspect, a preferred hydrofinishing catalyst can include a crystalline material belonging to the M41S class or family of catalysts. The M41S family of catalysts are mesoporous materials having high silica content. Examples include MCM-41, MCM-48 and MCM-50. A preferred member of this class is MCM-41.

Optionally, aromatic saturation or hydrofinishing catalysts may be located at other locations within a reaction system. In general, aromatic saturation catalysts can include catalysts containing Group VIB metals, Group VIII metals, and mixtures thereof. In an aspect, preferred metals include at least one metal sulfide having a strong hydrogenation function. In another aspect, the hydrofinishing catalyst can include a Group VIII noble metal, such as Pt, Pd, or a combination thereof, in an amount as described above. The mixture of metals may also be present as bulk metal catalysts wherein the amount of metal is about 30 wt. % or greater based on catalyst. Suitable metal oxide supports include low acidic oxides such as silica, alumina, silica-aluminas or titania, preferably alumina. The support materials may also be modified, such as by halogenation, or in particular fluorination. The metal content of the catalyst is often as high as about 20 weight percent for non-noble metals. In an embodiment, a preferred hydrofinishing catalyst can include a crystalline material belonging to the M41S class or family of catalysts. The M41S family of catalysts are mesoporous materials having high silica content. Examples include MCM-41, MCM-48 and MCM-50. A preferred member of this class is MCM-41.

Aromatic saturation conditions can include temperatures from about 125° C. to about 425° C., preferably about 180° C. to about 280° C., total pressures from about 300 psig (2.1 MPa) to about 3000 psig (20.7 MPa), preferably about 1000 psig (6.9 MPa) to about 2500 psig (17.2 MPa), liquid hourly space velocities from about 0.1 $hr^{-1}$ to about 30 $hr^{-1}$ LHSV, or about 0.5 $hr^{-1}$ to about 30 $hr^{-1}$, or about 0.5 $hr^{-1}$ to about 20 $hr^{-1}$, or about 1.0 $hr^{-1}$ to about 20 $hr^{-1}$, preferably about 1.0 $hr^{-1}$ to about 15 $hr^{-1}$, about 1.5 $hr^{-1}$ to about 15 $hr^{-1}$, or about 1.0 $hr^{-1}$ to about 10 $hr^{-1}$, or about 1.5 $hr^{-1}$ to about 10 $hr^{-1}$, or about 2.0 $hr^{-1}$ to about 20 $hr^{-1}$, or about 2.0 $hr^{-1}$ to about 15 $hr^{-1}$, and treat gas rates of from 35.6 $m^3/m^3$ to 1781 $m^3/m^3$ (200 SCF/B to 10,000 SCF/B), preferably 213 $m^3/m^3$ to about 1068 $m^3/m^3$ (1200 SCF/B to 6000 SCF/B) of a hydrogen-containing treat gas. The hydrogen-containing treat gas can contain at least about 80 vol % $H_2$, or at least about 90 vol %, or at least about 95 vol %, or at least about 98 vol %.

The aromatic saturation conditions can be effective for reducing the aromatics content of a feed. A feed to the aromatics saturation step can have an aromatics content of at least about 5 wt %, or at least about 10 wt %, or at least about 15 wt %, or at least about 20 wt % or at least about 25 wt %, or at least about 30 wt %, such as up to about 60 wt % or more. In some aspects, the amount of aromatics in the effluent from an aromatics saturation step can be characterized based on a weight percent of aromatics in the effluent. The aromatics content after aromatics saturation can be less than about 10 wt %, or less than about 7.5 wt %, or less than about 5 wt %, or less than about 3 wt %. In other aspects, the amount of aromatics in the effluent can be characterized relative to the amount of aromatics in the feed to the aromatics saturation step. For example, a ratio of aromatics in the effluent from aromatics saturation to aromatics in the feed can be about 0.6 or less, or about 0.5 or less, or about 0.4 or less, or about 0.3 or less, or about 0.2 or less, or about 0.15 or less, or about 0.1 or less.

Hydrocracking Conditions after Aromatic Saturation

Hydrocracking catalysts typically contain sulfided base metals on acidic supports, such as amorphous silica alumina, cracking zeolites or other cracking molecular sieves such as USY, or acidified alumina. In some preferred aspects, a hydrocracking catalyst can include at least one molecular sieve, such as a zeolite. Often these acidic supports are mixed or bound with other metal oxides such as alumina, titania or silica. Non-limiting examples of supported catalytic metals for hydrocracking catalysts include combinations of Group VIB and/or Group VIII non-noble metals, including nickel, nickel-cobalt-molybdenum, cobalt-molybdenum, nickel-tungsten, nickel-molybdenum, and/or nickel-molybdenum-tungsten. Support materials which may be used can comprise a refractory oxide material such as alumina, silica, alumina-silica, kieselguhr, diatomaceous earth, magnesia, zirconia, or combinations thereof, with alumina, silica, alumina silica being the most common (and preferred, in one embodiment).

The at least one Group VIII non-noble metal, in oxide form, can typically be present in an amount ranging from about 2 wt % to about 40 wt %, preferably from about 4 wt % to about 15 wt %. The at least one Group VIB metal, in oxide form, can typically be present in an amount ranging from about 2 wt % to about 70 wt %, preferably for supported catalysts from about 6 wt % to about 40 wt % or from about 10 wt % to about 30 wt %. These weight percents are based on the total weight of the catalyst. In some aspects, suitable hydrocracking catalysts can include nickel/molybdenum, nickel/tungsten, or nickel/molybdenum/tungsten as metals supported on the hydrocracking catalyst.

In some aspects, a hydrocracking catalyst can include a large pore molecular sieve that is selective for cracking of branched hydrocarbons and/or cyclic hydrocarbons. Zeolite Y, such as ultrastable zeolite Y (USY) is an example of a zeolite molecular sieve that is selective tier cracking of branched hydrocarbons and cyclic hydrocarbons. Depending on the aspect, the silica to alumina ratio in a USY zeolite can be at least about 10, such as at least about 15, or at least about 25, or at least about 50, or at least about 100. Depending on the aspect, the unit cell size for a USY zeolite can be about 24.50 Angstroms or less, such as about 24.45 Angstroms or less, or about 24.40 Angstroms or less, or about 24.35 Angstroms or less, such as about 24.30 Angstroms. In other aspects, a variety of other types of molecular sieves can be used in a hydrocracking catalyst, such as zeolite Beta and ZSM-5. Still other types of suitable molecular sieves can include molecular sieves having 10-member ring pore channels or 12-member ring pore channels. Examples of molecular sieves having 10-member ring pore channels or 12-member ring pore channels include molecular sieves having zeolite framework structures selected from MRE, MTT, EUO, AEL, AFO, SFF, STF, TON, OSI, ATO, GON, MTW, SFE, SSY, or VET.

In various embodiments, the conditions selected for hydrocracking can depend on the desired level of conversion, the level of contaminants in the input feed to the hydrocracking stage, and potentially other factors.

A hydrocracking process performed under non-sour conditions can be performed under conditions similar to those used for sour conditions, or the conditions can be different. Alternatively, a non-sour hydrocracking stage can have less severe conditions than a similar hydrocracking stage operating under sour conditions. Suitable hydrocracking conditions can include temperatures of about 450° F. (232° C.) to about 840° F. (449° C.), or about 450° F. (232° C.) to about 800° F. (427° C.), or about 450° F. (249° C.) to 750° F. (399° C.), or about 500° F. (260° C.) to about 840° F. (449° C.), or about 500° F. (260° C.) to about 800° F. (427° C.), or about 500° F. (260° C.) to about 750° F. (399° C.); hydrogen partial pressures of from about 250 psig to about 5000 psig (1.8 MPag to 34.6 MPag); liquid hourly space velocities of from 0.05 $h^{-1}$ to $10^{-1}$; and hydrogen treat gas rates of from 35.6 $m^3/m^3$ to 1781 $m^3/m^3$ (200 SCF/B to 10,000 SCF/B). In other embodiments, the conditions can include temperatures in the range of about 500° F. (260° C.) to about 815° F. (435° C.), or about 500° F. (260° C.) to about 750° F. (399° C.), or about 500° F. (260° C.) to about 700° C. (371° C.); hydrogen partial pressures of from about 500 psig to about 3000 psig (3.5 MPag-20.9 MPag); liquid hourly space velocities of from about 0.2 $h^{-1}$ to about 5 $h^{-1}$; and hydrogen treat gas rates of from about 213 $m^3/m^3$ to about 1068 $m^3/m^3$ (1200 SCF/B to 6000 SCF/B).

Dewaxing Process

In some optional aspects, a dewaxing catalyst can also be included for dewaxing of the hydrocracked effluent in the sweet processing stage. Suitable dewaxing catalysts can include molecular sieves such as crystalline aluminosilicates (zeolites). In an embodiment, the molecular sieve can comprise, consist essentially of, or be ZSM-5, ZSM-22, ZSM-23, ZSM-35, ZSM-48, zeolite Beta, ZSM-57, or a combination thereof, for example ZSM-23 and/or ZSM-48, or ZSM-48 and/or zeolite Beta. Optionally but preferably, molecular sieves that are selective for dewaxing by isomerization as opposed to cracking can be used, such as ZSM-48, zeolite Beta, ZSM-23, or a combination thereof. Additionally or alternately, the molecular sieve can comprise, consist essentially of or be a 10-member ring 1-D molecular sieve. Examples include EU-1, ZSM-35 (or ferrierite), ZSM-11, ZSM-57, NU-87, SAPO-11, ZSM-48, ZSM-23, and ZSM-22. Preferred materials are EV-2, EU-11, ZBM-30, ZSM-48, or ZSM-23. ZSM-48 is most preferred. Note that a zeolite having the ZSM-23 structure with a silica to alumina ratio of from about 20:1 to about 40:1 can sometimes be referred to as SSZ-32. Other molecular sieves that are isostructural with the above materials include Theta-1, NU-10, EU-13, KZ-1, and NU-23. Optionally but preferably, the dewaxing catalyst can include a binder for the molecular sieve, such as alumina, titania, silica, silica-alumina, zirconia, or a combination thereof, for example alumina and/or titania or silica and/or zirconia and/or titania.

Preferably, the dewaxing catalysts used in processes according to the invention are catalysts with a low ratio of silica to alumina. For example, for ZSM-48, the ratio of silica to alumina in the zeolite can be less than 200:1, or less than 110:1, or less than 100:1, or less than 90:1, or less than 80:1. In various embodiments, the ratio of silica to alumina can be from 30:1 to 200:1, 60:1 to 110:1, or 70:1 to 100:1.

In various embodiments, the catalysts according to the invention further include a metal hydrogenation component. The metal hydrogenation component is typically a Group VIB and/or a Group VIII metal. Preferably, the metal hydrogenation component is a Group VIII noble metal. Preferably, the metal hydrogenation component is Pt, Pd, or a mixture thereof. In an alternative preferred embodiment, the metal hydrogenation component can be a combination of a non-noble Group VIII metal with a Group VIB metal. Suitable combinations can include Ni, Co, or Fe with Mo or W, preferably Ni with Mo or W.

The amount of metal in the catalyst can be at least 0.1 wt % based on catalyst, or at least 0.15 wt %, or at least 0.2 wt %, or at least 0.25 wt %, or at least 0.3 wt %, or at least 0.5 wt % based on catalyst. The amount of metal in the catalyst can be 20 wt % or less based on catalyst, or 10 wt % or less, or 5 wt % or less, or 2.5 wt % or less, or 1 wt % or less. For embodiments where the metal is Pt, Pd, another Group VIII noble metal, or a combination thereof, the amount of metal can be from 0.1 to 5 wt %, preferably from 0.1 to 2 wt %, or 0.25 to 1.8 wt %, or 0.4 to 1.5 wt %. For embodiments where the metal is a combination of a non-noble Group VIII metal with a Group VIB metal, the combined amount of metal can be from 0.5 wt % to 20 wt %, or 1 wt % to 15 wt %, or 2.5 wt % to 10 wt %.

Process conditions in a catalytic dewaxing zone can include a temperature of about 200° C. to about 450° C., preferably about 270° C. to about 400° C., a hydrogen partial pressure of about 1.8 MPag to about 34.6 MPag (250 psig to 5000 psig), preferably about 4.8 MPag to about 20.8 MPag, and a hydrogen treat gas rate of about 35.6 $m^3/m^3$ (200 SCF/B) to about 1781 $m^3/m^3$ (10,000 scf/B), preferably about 178 $m^3/m^3$ (1000 SCF/B) to about 890.6 $m^3/m^3$ (5000 SCF/B). In still other embodiments, the conditions can include temperatures in the range of about 600° F. (343° C.) to about 815° F. (435° C.), hydrogen partial pressures of from about 500 psig to about 3000 psig (3.5 MPag-20.9 MPag), and hydrogen treat gas rates of from about 213 $m^3/m^3$ to about 1068 $m^3/m^3$ (1200 SCF. The LHSV can be from about 0.1 $h^{-1}$ to about such as from about 0.5 $h^{-1}$ to about 5 $h^{-1}$ and/or from about 1 $h^{-1}$ to about 4 $h^{-1}$.

Product Properties

Processing a feedstock to produce fuels according to methods described herein can provide a variety of advantages, in some aspects, the yield of total liquid product from hydrocracking in the sweet processing stage(s) can be increased. The yield of total liquid product from hydrocracking in the sweet hydroprocessing stage is defined as the weight of recovered products that are liquid at 25° C., 1 atm, relative to the weight of the input feed to the sweet hydroprocessing stage that is a liquid at 25° C., 1 atm. It is noted that any portion of the bottoms from fractionation that is recycled to the sweet hydroprocessing stage is included within the yield in this definition, so yield is a measure of the amount of gas phase product generated during a single pass through the sweet processing stage. In other aspects, the yield of one or yield of jet or kerosene boiling range product, or the yield of diesel boiling range product.

Additionally or alternately, the product quality of one or more products can be improved. In aspects where a feed is exposed a precious metal-containing aromatic saturation catalyst prior to hydrocracking, without being bound by any particular theory, it is believed that a desired level of conversion of the feed can be achieved using less severe hydrocracking conditions. As a result, it is believed that a larger percentage of the feed conversion is due to hydrocracking mechanisms rather than thermal cracking mechanisms, which leads to an increased amount of branched or isomerized compounds in the resulting products. This increase in the amount of branched or isomerized compounds can contribute to a variety of product quality improvements. For a jet or distillate boiling range fraction, an example of an improvement in product quality can correspond to an improvement in a cold flow property, such as a decrease in the freezing point of a jet boiling range fraction or the cloud point of a diesel boiling range fraction. For a naphtha boiling range fraction, an example of an improvement in product quality can correspond to an improvement in octane.

For a $C_4$ product fraction, an improvement in product quality can correspond to an increase in the ratio of isobutane to n-butane generated in the $C_4$ product fraction. Although a $C_4$ product fraction is not a liquid product at 25° C., 1 atm, a $C_4$ product fraction with a sufficiently high ratio of iso-$C_4$ to n-$C_4$ can be suitable for use as a feed to a reforming process. In a typical fuels hydrocracking process, a $C_4$ product can have a ratio of iso-$C_4$ to n-$C_4$ of about 4. In various aspects, a $C_4$ product from a hydrocracking process as described herein can have a higher ratio of of iso-$C_4$ to n-$C_4$, such as a ratio of iso-$C_4$ to n-$C_4$ of at least about 5, or at least about 5.5, or at least about 6.

EXAMPLE 1

Aromatic Saturation and Hydrocracking of Second Stage Hydrocracker Feed

In this example, a feed representative of a feed to a second stage of a fuels hydrocracking reaction system was processed under various conditions to demonstrate the benefit of contacting the feed with a precious metal-containing aromatic saturation catalyst prior to hydrocracking. The feed was a hydrocracked gas oil with a specific gravity of about 0.877 g/ml, a sulfur content of about 20 wppm, a nitrogen content of about 1.2 wppm, and an initial aromatics content of about 20 wt %.

The feed was processed by exposing the feed to two catalysts according to the reaction conditions shown in Table 1. The two catalysts corresponded to a commercially available hydrocracking catalyst and a commercially available aromatic saturation catalyst. The hydrocracking catalyst was a bound molecular sieve with nickel and tungsten supported on the catalyst as catalytic metals. The aromatic saturation catalyst had a combination of platinum and palladium supported on an alumina support. The ratio of hydrocracking catalyst to aromatic saturation catalyst was 80:20 by weight. In a first type of processing run, the feed was exposed to the hydrocracking catalyst first, while in the second type of processing run the feed was exposed to the aromatic saturation catalyst first. For the processing runs in Table 1, the catalysts were located in separate reactors, with the effluent from the first reactor in series being cascaded into the second reactor.

As shown in Table 1, the LHSV, the pressure, and the treat gas rate were substantially the same when processing with both types of catalyst configurations. The temperature was adjusted in the processing runs to achieve the same level of feed conversion across the hydrocracking catalyst. As shown in Table 1, the temperature required to achieve 15.6 wt % conversion of the feed (relative to a conversion temperature of 430° F.) differed by about 20° F. (11° C.) for the catalyst configuration with the hydrocracking catalyst as the upstream catalyst as compared to the configuration with the aromatic saturation catalyst as the upstream catalyst. This demonstrates that substantially less severe hydrocracking conditions could be used to hydrocrack the feed to a desired conversion level by first exposing the feed to the precious metal-containing aromatic saturation catalyst. Without being bound by any particular theory, it is believed that the difference in the hydrocracking temperature to achieve the desired level of conversion is due in part to the reduced aromatics content after exposing the feed to the aromatics saturation catalyst. In the conventional catalyst configuration, the feed has about 20 wt % aromatics content when exposed to the hydrocracking catalyst. Even after hydrocracking, in the conventional configuration the hydrocracked feed still has an aromatics content of about 12 wt %. By contrast, exposing the feed to the aromatics saturation catalyst first reduces the aromatics content to less than about 1.5 wt %. This allows the hydrocracking step to be performed on a feed with a substantially reduced aromatics content. As shown in Table 1, the final effluent from both configurations has an aromatics content of less than about 1.5 wt %.

It is noted that the aromatic saturation temperatures are different between the two types of processing runs. For the situation where the feed was first exposed to the hydrocracking catalyst, the temperature for aromatic saturation was constrained based on the ability to cool the hydrocracking effluent prior to passing the effluent into the aromatic saturation reactor. When exposing the feed to the aromatic saturation catalyst first, the aromatic saturation temperature was selected so that the resulting effluent had approximately the desired temperature for hydrocracking. It is noted that a wide variety of aromatic saturation temperatures (both higher and lower than the conditions in Table 1) would have provided sufficient aromatic saturation.

Table 1 also shows the results of characterizing the products from processing the feed using the two different types of catalyst systems. As shown in Table 1, the total liquid yield ($C_5$+ yield) is increased by more than about 0.5 wt % by exposing the feed first to the aromatic saturation catalyst. The distillate fuel yield is also increased by at least about 1 wt %. Yield increases on the order of 1 wt % can represent substantial efficiency improvements in a commercial refinery context. It is noted that these yield improvements are achieved while maintaining a substantially constant amount of hydrogen consumption.

The product quality of the resulting products is also improved in Table 1. Table 1 shows the freezing point for a kerosene product with a boiling range of 190° F. (88° C.) to 430° F. (221° C.). The kerosene product produced by treating the feed with the aromatic saturation catalyst first had a freezing point that was at least about 8° F. lower than the corresponding kerosene product produced by first exposing the feed to the hydrocracking catalyst. This improvement in the freezing point in the kerosene fraction is believed to be due to the presence of additional branched or isomerized compounds in the kerosene fraction. Because the kerosene fraction has overlap with a traditional naphtha boiling range fraction, the improvement in freezing point for the kerosene boiling range fraction indicates that the corresponding naphtha boiling range fraction should have an improved octane rating.

It is also noted that exposing the feed to the aromatic saturation catalyst first resulted in a $C_4$ portion of the light ends that had an unexpectedly high ratio of isomerized $C_4$ compounds relative to unbranched $C_4$ compounds. As shown in Table 1, exposing the feed to the hydrocracking catalyst first resulted in a ratio of isomerized $C_4$ products to unbranched $C_4$ products (iso-$C_4$/n-$C_4$) of about 4. This is the ratio of iso-$C_4$ to n-$C_4$ that would be expected in the products from a fuels hydrocracking process. By contrast, exposing the feed to the aromatic saturation catalyst first produced a $C_4$ product with an iso-$C_4$ to n-$C_4$ ratio of about 6. This unexpected increase in the iso-$C_4$ to n-$C_4$ ratio makes the $C_4$ product more valuable for use as a feed to an alkylation unit, where iso-$C_4$ compounds can be used to generate higher octane naphtha boiling range compounds.

TABLE 1

Processing of Second Stage Hydrocracker Feed

| | Hydrocracking => Aromatic Saturation | Aromatic Saturation => Hydrocracking |
|---|---|---|
| Hydrocracking Temperature (° F.) | 555 | 535 |
| Aromatic Sat Temperature (° F.) | 557 | 515 |
| LHSV ($hr^{-1}$) | 0.94 | 0.94 |
| Pressure (psig) | 1157 | 1157 |
| Treat Gas Rate (scf/b) | 3717 | 3725 |
| 430° F.+ Conversion (wt %) | 15.6% | 15.6% |
| $H_2$ Consumption (scf/b) | 1317 | 1319 |
| $C_1$-$C_4$ yield (wt %) | 2.15 | 1.59 |
| $C_5$+ yield (wt %) | 100.07 | 100.63 |
| Distillate (350° F.+) yield (wt %) | 78.68 | 80.76 |
| $iC_4$/n-$C_4$ | 3.94 | 6.24 |
| Jet (290-430° F.) Freezing Point (° F.) | −68 | Less than −76 |
| Aromatics wt % after first catalyst | 12.2 | <1.5 |
| Aromatics wt % after both catalysts | <1.5 | <1.5 |

Additional Embodiments

Embodiment 1

A method for processing a feedstock to form a distillate product, comprising: exposing a feedstock having a 150 boiling point of at least about 430° F. (221° C.), a first aromatics content, and a sulfur content of about 500 wppm or less (or about 100 wppm or less, or about 50 wppm or less, or about 15 wppm or less) to an aromatic saturation catalyst comprising a Group VIII noble metal under effective aromatic saturation conditions to produce an aromatic saturation effluent, the aromatic saturation effluent having a second aromatics content, a ratio of the second aromatics content to the first aromatics content being about 0.6 or less; and exposing at least a portion of the aromatic saturation effluent to a hydrocracking catalyst under effective hydrocracking conditions to produce a hydrocracked effluent, the effective hydrocracking conditions being effective for converting at least about 5 wt % of the at least a portion of the aromatic saturation effluent relative to a conversion temperature of 430° F. (221° C.), the hydrocracking catalyst comprising at least one Group VIII non-noble metal, at least one Group VIB metal, or a combination thereof; wherein the hydrocracked effluent comprises at least a naphtha fuel product fraction and a distillate fuel product fraction.

Embodiment 2

The method of Embodiment 1, wherein the ratio of the second aromatics content to the first aromatics content is about 0.5 or less, or about 0.4 or less, or about 0.3 or less, or about 0.2 or less, or about 0.15 or less, or about 0.1 or less.

Embodiment 3

A method for processing a feedstock to form a distillate product, comprising: exposing a feedstock having a T50 boiling point of at least about 430° F. (221° C.), a first aromatics content of at least about 5 wt %, and a sulfur content of about 500 wppm or less (or about 100 wppm or less, or about 50 wppm or less, or about 15 wppm or less) to an aromatic saturation catalyst comprising a Group VIII noble metal under effective aromatic saturation conditions to produce an aromatic saturation effluent, the aromatic saturation effluent having a second aromatics content of less than about 10 wt %, the second aromatics content being less than the first aromatics content; and exposing at least a portion of the aromatic saturation effluent to a hydrocracking catalyst under effective hydrocracking conditions to produce a hydrocracked effluent, the effective hydrocracking conditions being effective for converting at least about 5 wt % of the at least a portion of the aromatic saturation effluent relative to a conversion temperature of 430° F. (221° C.), the hydrocracking catalyst comprising at least one Group VIII non-noble metal, at least one Group VIB metal, or a combination thereof, wherein the hydrocracked effluent comprises at least a naphtha fuel product fraction and a distillate fuel product fraction.

Embodiment 4

The method of any of the above embodiments, wherein the first aromatics content is at least about 10 wt %, or at least about 15 wt %, or at least about 20 wt %, or at least about 25 wt %, or wherein the second aromatics content is less than about 7.5 wt %, or less than about 5 wt %, or less than about 3 wt %, or a combination thereof.

Embodiment 5

The method of any of the above embodiments, wherein the feedstock has a T5 boiling point of at least about 430° F. (221° C.).

Embodiment 6

The method of any of the above embodiments, wherein the feedstock has a T95 boiling point of about 1050° F. (566° C.) or less, or about 800° F. or less.

Embodiment 7

The method of any of the above embodiments, further comprising fractionating at least a portion of the hydrocracked effluent to form at least a naphtha product fraction and a bottoms fraction.

Embodiment 8

The method of Embodiment 7, wherein the feedstock comprises at least a portion of the bottoms fraction.

Embodiment 9

The method of any of Embodiments 7 or 8, wherein the bottoms fraction comprises the distillate fuel product fraction.

Embodiment 10

The method of any of Embodiments 7 to 9, wherein fractionating at least a portion of the hydrocracked effluent further comprises separating a $C_4$ product stream from the hydrocracked effluent, the separated $C_4$ product stream having an iso-$C_4$ to n-$C_4$ ratio of at least about 5.

Embodiment 11

The method of any of the above embodiments, further comprising exposing a feed having a sulfur content of greater than about 500 wppm to a hydroprocessing catalyst under effective hydroprocessing conditions to form a hydroprocessed effluent; and separating the hydroprocessed effluent to form at least a hydroprocessed fraction having a T95 boiling point of about 1050° F. (566° C.) or less, or a T95 boiling point of about 800° F. (427° C.) or less, wherein the feedstock having a T50 boiling point of at least about 430° F. (221° C.) comprises at least a portion of the hydroprocessed fraction having a T95 boiling point of about 1050° F. (566° C.) or less, or a T95 boiling point of about 800° F. (427° C.) or less.

Embodiment 12

The method of Embodiment 11, wherein separating the hydroprocessed effluent comprises fractionating the hydroprocessed effluent, the fractionating optionally further comprising forming a second naphtha fuel product fraction.

Embodiment 13

The method of any of Embodiments 11 or 12, wherein the hydroprocessed effluent and the hydrocracked effluent are fractionated in a common fractionation process.

Embodiment 14

The method of any of Embodiments 11 to 13, wherein exposing the feed having a sulfur content of at least about 500 wppm to a hydroprocessing catalyst under effective hydroprocessing conditions comprises: exposing the feed having a sulfur content of greater than about 500 wppm to a hydrotreating catalyst under effective hydrotreating conditions, exposing the feed having a sulfur content of greater than about 500 wppm to a hydrocracking catalyst under effective hydrocracking conditions, or a combination thereof.

Embodiment 15

The method of any of Embodiments 11 to 14, wherein the feed having a sulfur content of greater than about 500 wppm has a T5 boiling point of at least about 430° F. (221° C.) and a T95 boiling point of about 1050° F. (566° C.) or less, or a T95 boiling point of about 800° F. (427° C.) or less.

Embodiment 16

The method of any of Embodiments 11 to 15, wherein at least about 50 wt % of the feedstock having a T50 boiling point of at least about 430° F. (221° C.) comprises the at least a portion of the hydroprocessed fraction having a T95 boiling point of about 1050° F. (566° C.) or less, or a 195 boiling point of about 800° F. or less.

Embodiment 17

The method of any of the above embodiments, wherein aromatic saturation catalyst comprises about 0.1 wt % to about 1.8 wt % of Pt, Pd, or a combination thereof.

Embodiment 18

The method of any of the above claims, further comprising dewaxing the hydrocracked effluent prior to fractionating the at least a portion of the hydrocracked effluent.

Embodiment 19

The method of Embodiment 3, wherein a ratio of the second aromatics content to the first aromatics content is about 0.6 or less, or about 0.5 or less, or about 0.4 or less, or about 0.3 or less, or about 0.2 or less, or about 0.15 or less, or about 0.1 or less.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The present invention has been described above with reference to numerous embodiments and specific examples. Many variations will suggest themselves to those skilled in this art in light of the above detailed description. All such obvious variations are within the full intended scope of the appended claims.

What is claimed is:

1. A method for processing a feedstock to form a distillate product, comprising:

first exposing a feedstock having a T50 boiling point of at least about 430° F. (221° C.), a first aromatics content of at least about 5 wt %, and a sulfur content of about 500 wppm or less to an aromatic saturation catalyst comprising a Group VIII noble metal under effective aromatic saturation conditions to produce an aromatic saturation effluent, the aromatic saturation effluent having a second aromatics content of less than about 10 wt %, the second aromatics content being less than the first aromatics content; and then exposing at least a portion of the aromatic saturation effluent to a hydrocracking catalyst under effective hydrocracking conditions to produce a hydrocracked effluent, the effective hydrocracking conditions being effective for converting at least about 5 wt % of the at least a portion of the aromatic saturation effluent relative to a conversion temperature of 430° F. (221° C.), the hydrocracking catalyst comprising at least one Group VIII non-noble metal, at least one Group VIB metal, or a combination thereof, wherein the hydrocracked effluent comprises at least a naphtha fuel product fraction and a distillate fuel product fraction; wherein the hydrocracked effluent includes a $C_4$ product fraction having an iso-$C_4$ to n-$C_4$ ratio of at least about 5.

2. The method of claim 1, wherein a ratio of the second aromatics content to the first aromatics content is about 0.5 or less.

3. The method of claim 1, wherein the second aromatics content is less than about 5 wt %.

4. The method of claim 1, wherein the first aromatics content is at least about 10 wt %.

5. The method of claim 1, wherein the feedstock has a T5 boiling point of at least about 430° F. (221° C.).

6. The method of claim 1, wherein the feedstock has a T95 boiling point of about 800° F. (427° C.) or less.

7. The method of claim 1, further comprising fractionating at least a portion of the hydrocracked effluent to form at least a naphtha product fraction and a bottoms fraction.

8. The method of claim 7, wherein the feedstock comprises at least a portion of the bottoms fraction.

9. The method of any of claim 7, wherein the bottoms fraction comprises the distillate fuel product fraction.

10. The method of any of claim 7, wherein fractionating at least a portion of the hydrocracked effluent further comprises separating a $C_4$ product stream from the hydrocracked effluent, the separated $C_4$ product stream having an iso-$C_4$ to n-$C_4$ ratio of at least about 5.

11. The method of claim 1, further comprising exposing a feed having a sulfur content of greater than about 500 wppm to a hydroprocessing catalyst under effective hydroprocessing conditions to form a hydroprocessed effluent; and separating the hydroprocessed effluent to form at least a hydroprocessed fraction having a T95 boiling point of about 1050° F. (566° C.) or less, wherein the feedstock having a T50 boiling point of at least about 430° F. (221° C.) comprises at least a portion of the hydroprocessed fraction having a T95 boiling point of about 1050° F. (566° C.) or less.

12. The method of claim 11, wherein separating the hydroprocessed effluent comprises fractionating the hydroprocessed effluent, the fractionating optionally further forming a second naphtha fuel product fraction.

13. The method of claim 11, wherein the hydroprocessed effluent and the hydrocracked effluent are fractionated in a common fractionation process.

14. The method of claim 11, wherein exposing the feed having a sulfur content of at least about 500 wppm to a hydroprocessing catalyst under effective hydroprocessing conditions comprises:

exposing the feed having a sulfur content of greater than about 500 wppm to a hydrotreating catalyst under effective hydrotreating conditions, exposing the feed having a sulfur content of greater than about 500 wppm to a hydrocracking catalyst under effective hydrocracking conditions, or a combination thereof.

15. The method of claim 11, wherein the feed having a sulfur content of greater than about 500 wppm has a T5 boiling point of at least about 430° F. (221° C.) and a T95 boiling point of about 1050° F. (566° C.) or less.

16. The method of claim 11, wherein at least about 50 wt % of the feedstock having a T50 boiling point of at least about 430° F. (221° C.) comprises the at least a portion of the hydroprocessed fraction having a T95 boiling point of about 1050° F. (566° C.) or less.

17. The method of claim 1, wherein aromatic saturation catalyst comprises about 0.1 wt % to about 1.8 wt % of Pt, Pd, or a combination thereof.

18. The method of claim 1, further comprising dewaxing the hydrocracked effluent prior to fractionating the at least a portion of the hydrocracked effluent.

19. A method for processing a feedstock to form a distillate product, comprising:

first exposing a feedstock having a T50 boiling point of at least about 430° F. (221° C.), a first aromatics content, and a sulfur content of about 500 wppm or less to an aromatic saturation catalyst comprising a Group VIII noble metal under effective aromatic saturation conditions to produce an aromatic saturation effluent, the aromatic saturation effluent having a second aromatics content, a ratio of the second aromatics content to the first aromatics content being about 0.6 or less; and then exposing at least a portion of the aromatic saturation effluent to a hydrocracking catalyst under effective hydrocracking conditions to produce a hydrocracked effluent, the effective hydrocracking conditions being effective for converting at least about 5 wt % of the at least a portion of the aromatic saturation effluent relative to a conversion temperature of 430° F. (221° C.), the hydrocracking catalyst comprising at least one Group VIII non-noble metal, at least one Group VIB metal, or a combination thereof;

wherein the hydrocracked effluent comprises at least a naphtha fuel product fraction and a distillate fuel product fraction; wherein the hydrocracked effluent includes a $C_4$ product fraction having an iso-$C_4$ to n-$C_4$ ratio of at least about 5.

20. The method of claim 19, wherein the ratio of the second aromatics content to the first aromatics content is about 0.3 or less.

* * * * *